US006546629B2

(12) United States Patent
Politi

(10) Patent No.: US 6,546,629 B2
(45) Date of Patent: Apr. 15, 2003

(54) METHOD AND APPARATUS FOR PRODUCING A VEHICLE WHEEL

(75) Inventor: Dominic Politi, Windsor (CA)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/888,135

(22) Filed: Jun. 22, 2001

(65) Prior Publication Data

US 2001/0052186 A1 Dec. 20, 2001

Related U.S. Application Data

(63) Continuation of application No. PCT/US99/31283, filed on Dec. 29, 1999

(60) Provisional application No. 60/114,109, filed on Dec. 29, 1998.

(51) Int. Cl.[7] ..... B23P 17/00

(52) U.S. Cl. ..... 29/894.322; 29/525; 29/802

(58) Field of Search ..... 29/894.322, 894.323, 29/525, 802

(56) References Cited

U.S. PATENT DOCUMENTS

| | | | | |
|---|---|---|---|---|
| 4,646,434 | A | 3/1987 | Daudi | 29/802 |
| 4,841,622 | A | 6/1989 | Murano | |
| 5,188,429 | A | 2/1993 | Heck | |
| 5,421,642 | A | 6/1995 | Archibald | |
| 5,694,687 | A | 12/1997 | Coleman | 29/894.323 |
| 6,357,116 | B1 * | 3/2002 | Waelchli et al. | 29/802 |

FOREIGN PATENT DOCUMENTS

| | | |
|---|---|---|
| JP | 64-83402 | 3/1989 |
| WO | WO99/15306 | 4/1999 |

* cited by examiner

*Primary Examiner*—P. W. Echols
(74) *Attorney, Agent, or Firm*—MacMillan, Sobanski & Todd, LLC

(57) ABSTRACT

A method for assembling a wheel rim and a wheel disc together to produce a vehicle wheel includes the steps of: (a) providing a rim defining an axis and including an inboard tire bead seat retaining flange, an inboard tire bead seat, a well portion, an outboard tire bead seat, and an outboard tire bead seat retaining flange, the inboard tire bead seat retaining flange including a radially extending first inner surface, the well portion including a radially extending second inner surface, the outboard tire bead seat retaining flange including a radially extending third inner surface; (b) providing a disc having a centrally located inner wheel mounting portion and an outer annular portion which terminates in an axially extending outer annular flange, the inner wheel mounting portion including an inboard mounting surface and an outboard mounting surface, the outer annular portion including an inner surface; (c) supporting the rim at the first inner and at least one of the second inner surface and the third inner surface; (d) supporting the disc at the inboard mounting surface and the outboard mounting surface; (e) selectively moving at least one of the rim and the disc toward one another to cause the outer annular flange of the disc to engage an inner surface of the rim in a press fit engagement therewith while supporting the rim and the disc as recited in steps (c) and (d), the rim and disc being selectively moved to produce a desired lateral runout dimension defined between the inboard mounting surface of the disc and the first inner surface of the inboard tire bead seat retaining flange of the rim; and (f) subsequent to step (e), welding the disc to the rim to thereby permanently join the rim and the disc together and produce the vehicle wheel.

17 Claims, 7 Drawing Sheets

METHOD AND APPARATUS FOR PRODUCING A VEHICLE WHEEL

CROSS-REFERENCE TO RELATED APPLICATIONS

This application claims the benefit of U.S. Provisional Application Serial No. 60/114,109, filed Dec. 29, 1998, and is a continuation of International Application No. PCT/US99/31283, filed Dec. 29, 1999.

BACKGROUND OF THE INVENTION

This invention relates in general to vehicle wheels and in particular to an improved method and apparatus for producing a vehicle wheel.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding.

In the above vehicle wheel constructions, after the wheel disc and the wheel rim have been assembled and welded together several finishing operations may be required to produce a wheel having the desired specifications. First, at least one of the inboard and outboard tire bead seats and/or at least one of the inboard and outboard tire bead seat retaining flanges may have to be generally be processed so that the tire bead seats are oriented and located coaxial with the wheel axis (commonly referred to as "radial runout"), and the tire bead seat retaining flanges are oriented in a parallel relationship relative to an inboard mounting surface of the wheel disc (commonly referred to as "lateral" or "axial" runout"). Following this, the location of center pilot hole, the lug receiving holes, or both may have to be corrected by an appropriate method, such as reboring the center pilot hole and repunching the lug receiving holes, so that an axis of the center pilot hole is oriented in a coaxial relationship relative to the wheel axis and the tire bead seats and the axes of the lug receiving holes are oriented parallel to the wheel axis.

FIGS. 6 and 7 illustrate a typical prior art assembly tooling apparatus, indicated generally at 200, which is used to assemble a prior art wheel disc 220 and a prior art wheel rim 240 together to produce a vehicle wheel. The prior assembly tooling apparatus 200 includes a plurality tooling members which are moveable between an intermediate working position, shown in prior art FIG. 6, and a final working position, shown in prior art FIG. 7.

As shown in prior art FIGS. 6 and 7, the prior art assembly tooling apparatus 200 includes a wheel rim tooling station, indicated generally at 202, and a wheel disc tooling station, indicated generally at 204. The wheel rim tooling station 202 includes an upper wheel rim detail tooling member 206 and a lower wheel rim detail tooling member 208. The upper wheel rim detail tooling member 206 includes a pair of tooling members 206A and 206B which are connected together by a plurality of bolts 207 (only one of such bolts 207 is illustrated in FIGS. 6 and 7). The tooling members 206A and 206B can be uninterrupted continuous annular tooling members which are effective to engage and support a generally radially extending inner surface 242A of an inboard tire bead seat retaining flange 242 of the wheel rim 240 around the entire periphery thereof, or can be a segmented tooling member (i.e., not an uninterrupted continuous tooling member), so as not to provide full (i.e., 360 degree) contact and support at the associated surface.

The lower wheel rim detail tooling member 208 includes a pair of tooling members 208A and 208B which are connected together by a plurality of bolts 209 (only one of such bolts 209 is illustrated in FIGS. 6 and 7). The tooling members 208A and 208B can be uninterrupted continuous annular tooling members which are effective to engage and support a generally radially outwardly extending inner surface 246A of a section of a well 246 of the wheel rim 240 around the entire periphery thereof, or can be a segmented tooling member (i.e., not an uninterrupted continuous tooling member), so as not to provide full (i.e., 360 degree) contact and support at the associated surface. In addition, the lower wheel rim detail tooling member 208 can include a locating member 211 which is adapted to extend through a valve stem opening 240A provided in the wheel rim 240. The lower wheel rim detail tooling member 208 is selectively moveable by a cylinder B1 which is actuated by suitable means, such as such as by hydraulic, pneumatic, or similar means.

The wheel disc tooling station 204 includes an outer retainer 212, an inner retainer 214, a center pilot plug 216, and a bottom center detail tooling member 218. The inner retainer 214 is operatively connected to the outer retainer 212 by one or more bolts 215 and is selectively moveable by a cylinder B2. The center pilot plug 216 is operatively connected to the inner retainer 214 by a bolt 219 and moveable therewith, and the bottom center detail tooling member 218 is selectively moveable by a cylinder B3. The cylinders B2, and B3 are actuated by suitable means, such as by hydraulic, pneumatic, or similar means.

The outer retainer 212 is preferably an uninterrupted continuous annular member which is effective to engage and support an inner surface 224A of an outer annular portion 224 of the wheel disc 220 around the entire periphery thereof, or can be a segmented tooling member (i.e., not an uninterrupted continuous tooling member), so as not to provide full (i.e., 360 degree) contact and support at the associated surface. The inner retainer 214 includes a plurality of separate tooling members (four of such tooling members 214A–214D being illustrated in FIGS. 6 and 7), which are operatively connected together by suitable means, such as for example by bolts 217A–217C. The tooling member 214D is preferably an uninterrupted continuous annular tooling member which is effective to engage and support an inboard mounting surface 222A of a wheel mounting portion 222 of the wheel disc 220 around the entire periphery thereof. The center pilot plug 216 defines an outer diameter which is slightly less than an inner diameter defined by the center pilot hole 228 of the wheel disc 220 so as to be received therein in a slight interference fit therewith.

The bottom center detail tooling member 218 includes a plurality of separate tooling members 218A–218C which are connected together by bolts 219A and 219B and which are operatively connected to the cylinder B3. The tooling member 218B includes an outer annular extension 224 which is effective to engage an outer surface 222B of the wheel disc 220 adjacent the bolt hole openings 230 except at the embossed surface areas of the bolt hole openings 230 or any other non-uniform surface area located thereon. The tooling member 218B further includes a locating member 221 which is adapted to extend through one of the bolt hole openings 230 provided in the wheel disc 220.

The prior art assembly tooling apparatus 200 shown in FIGS. 6 and 7 is operated in the following manner to assemble the wheel disc 220 and the wheel rim 240 together. First, the wheel rim 240 and the wheel disc 220 are supported by the assembly tooling apparatus 200 as shown in FIG. 6. In particular, the wheel rim 240 is engaged and supported at the surface 246A by the tooling member 208A, and the wheel disc 220 is engaged and supported at the surfaces 224A, 222A, 222B, 228, and 230 by the tooling members 212, 214D, 218B, 216, and 221 respectively. Next, with the wheel disc 220 held stationary by the tooling members 212, 214, 216, 218, and 221, and the wheel rim 240 supported by the tooling member 208A, the wheel rim 240 is moved upwardly relative to the wheel disc 220 in the direction of the arrow N (shown in FIG. 6) a predetermined distance from the position shown in FIG. 6 to the position shown in FIG. 7 so as to "press in" the wheel rim 240 and assemble the wheel rim 240 and the wheel disc 220 together in a press-fit relationship. In particular, the wheel rim 240 and the wheel disc 220 are assembled together so as to precisely locate the inboard mounting surface 222A of the wheel disc 220 a predetermined lateral distance K relative to the inner surface 242A of the inboard tire bead seat retaining flange 242 of the wheel rim 220. As can be seen in FIG. 7, when the wheel rim 240 is pressed into the wheel disc 220 so as to provide the predetermined lateral runout distance K, the inner surface 242A of an inboard tire bead seat retaining flange 242 of the wheel rim 240 is engaged by the tooling member 206A of the upper wheel rim detail tooling member 206. Following this, the assembled wheel disc 220 and wheel rim 240 are permanently joined together by a weld (not shown) in a known manner.

SUMMARY OF THE INVENTION

This invention relates to an improved method and apparatus for producing a vehicle wheel. The method for assembling a wheel rim and a wheel disc together to produce the vehicle wheel includes the steps of: (a) providing a wheel rim defining an axis and including an inboard tire bead seat retaining flange, an inboard tire bead seat, a well portion, an outboard tire bead seat, and an outboard tire bead seat retaining flange, the inboard tire bead seat retaining flange including a generally radially extending first inner surface, the well portion including a generally radially extending second inner surface, the outboard tire bead seat retaining flange including a generally radially extending third inner surface; (b) providing a wheel disc having a generally centrally located inner wheel mounting portion and an outer annular portion which terminates in a generally axially extending outer annular flange, the inner wheel mounting portion including an inboard mounting surface and an outboard mounting surface, the outer annular portion including an inner surface; (c) supporting the wheel rim at the first inner and at least one of the second inner surface and the third inner surface; (d) supporting the wheel disc at the inboard mounting surface and the outboard mounting surface of the inner wheel mounting portion; (e) selectively moving at least one of the wheel rim and the wheel disc toward one another to cause the outer annular flange of the wheel disc to engage an inner surface of the wheel rim in a press fit engagement therewith while supporting the wheel rim and the wheel disc as recited in steps (c) and (d), the wheel rim and the wheel disc being selectively moved to produce a desired lateral runout dimension defined between the inboard mounting surface of the wheel disc and the first inner surface of the inboard tire bead seat retaining flange of the wheel rim; and (f) subsequent to step (e), welding the wheel disc to the wheel rim to thereby permanently join the wheel rim and the wheel disc together and produce the vehicle wheel.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
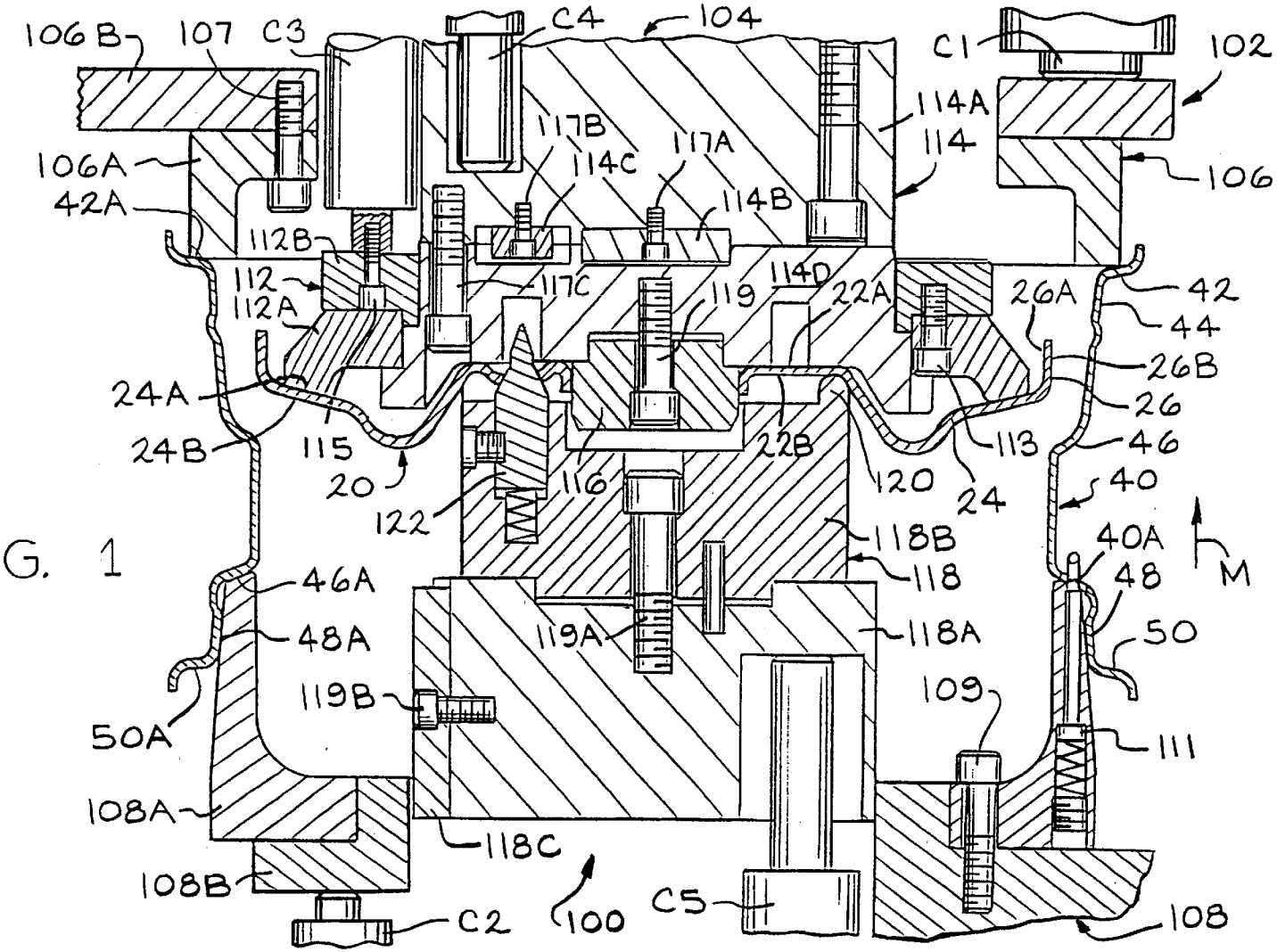
FIG. 1 is a sectional elevational view illustrating a first embodiment of an assembly tooling apparatus for producing a vehicle wheel in accordance with this invention, the tooling assembly apparatus being illustrated in an intermediate working position.
Figure 4:
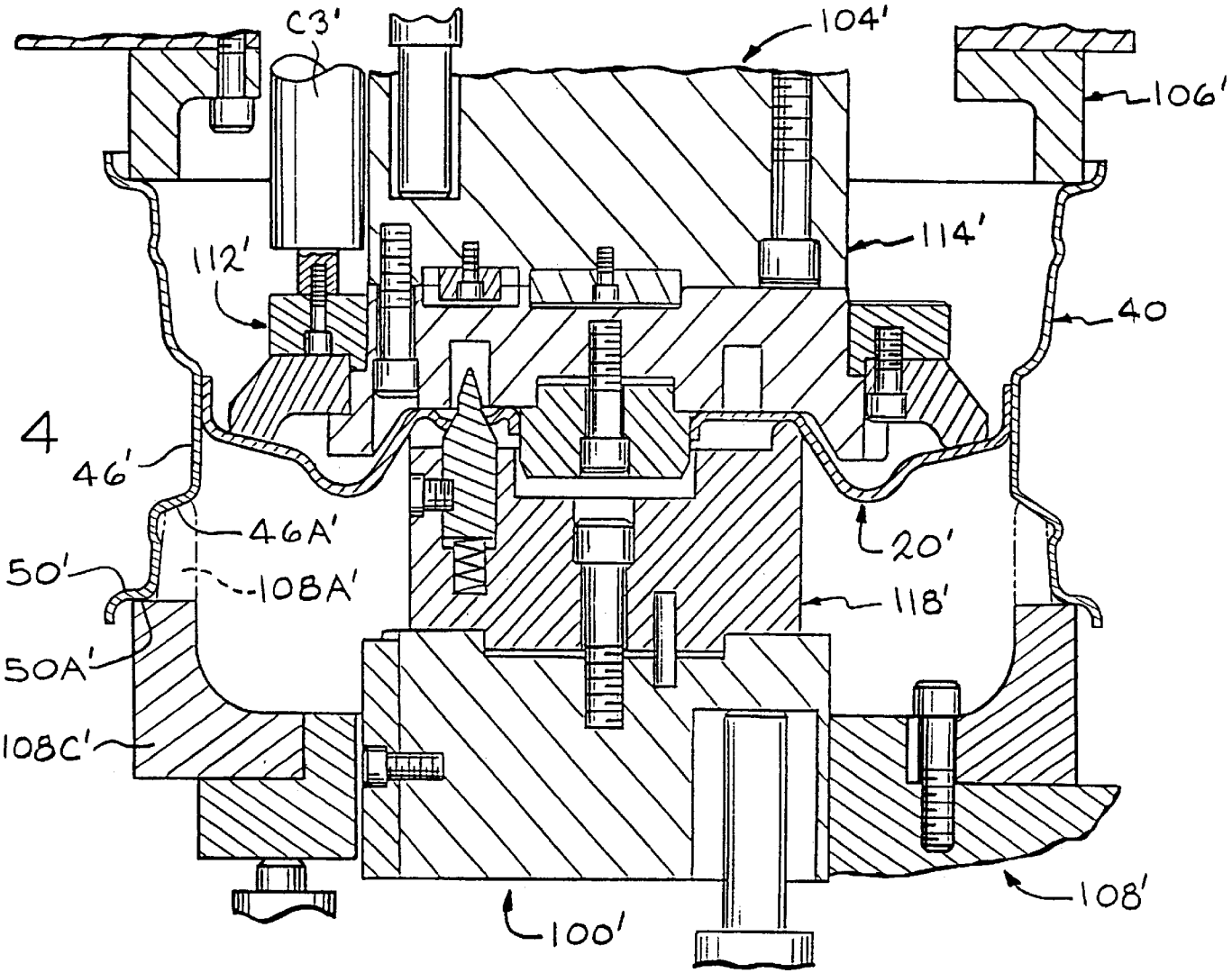
FIG. 4 is a sectional elevational view of the assembly tooling apparatus illustrated in FIG. 3, the tooling assembly apparatus being illustrated in a final working position.
Figure 5:
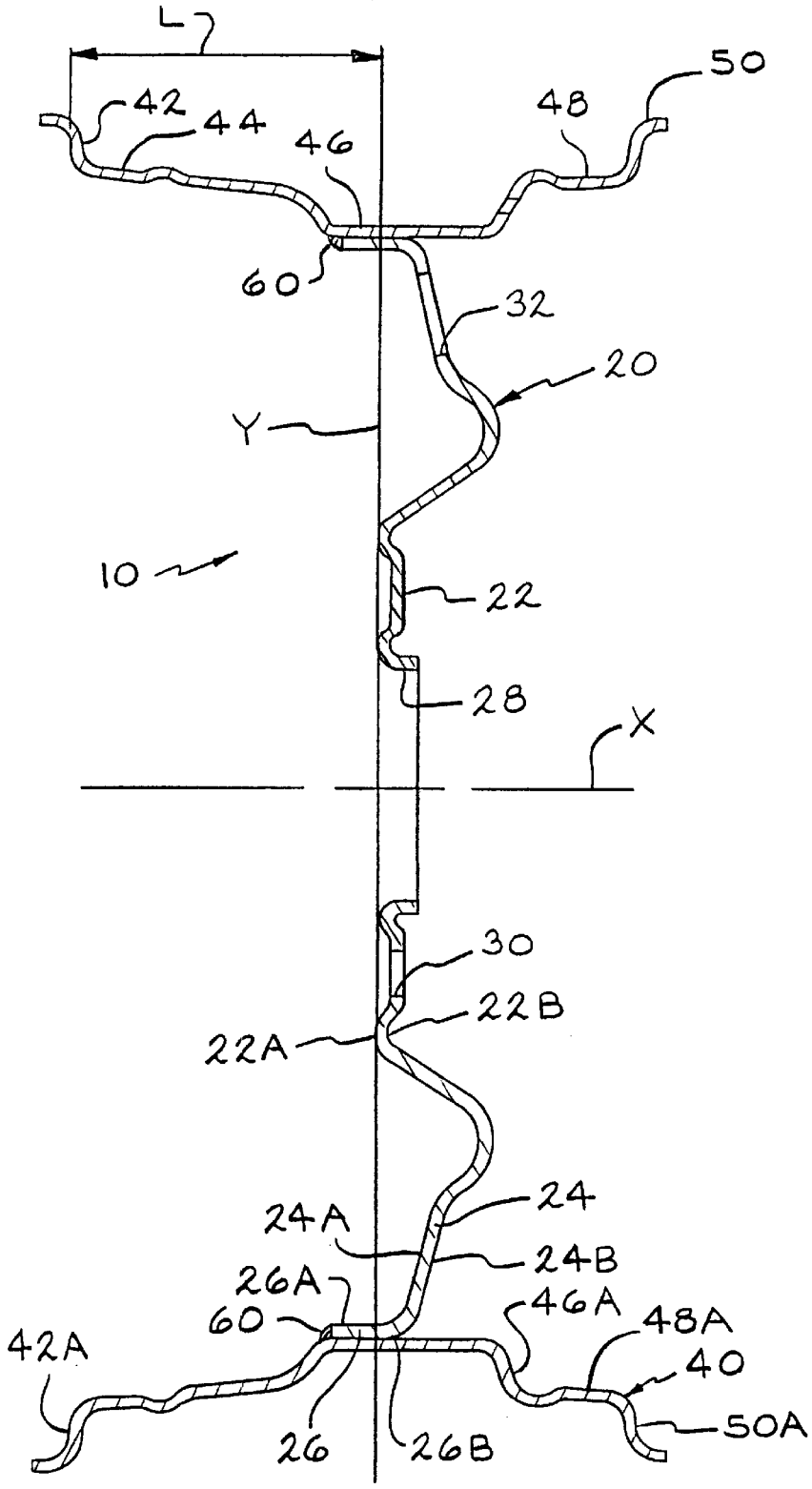
FIG. 5 is a sectional view of a vehicle wheel produced in accordance with the present invention.

Referring now to the drawings, there is illustrated in FIG. 1 a first embodiment of an assembly tooling apparatus, indicated generally at 100, for producing a vehicle wheel, indicted generally at 10 in FIG. 5, in accordance with this invention. As shown in FIG. 5, the vehicle wheel 10 is illustrated as being a "well attached" vehicle wheel, and includes a wheel disc 20 and a wheel rim 40 which are joined together by a weld 60 and which define a vehicle wheel axis X. Although the present invention is illustrated and described in conjunction with the particular vehicle wheel construction disclosed herein, it will be appreciated that the invention can be used in conjunction with other types of vehicle wheel constructions. For example, the vehicle wheel can be a "bead seat attached" vehicle wheel, similar to that shown in FIG. 4 of U.S. Pat. No. 5,188,429 to Heck et al. or FIG. 30 of U.S. Pat. No. 5,694,687 to Coleman, or a "bimetal" vehicle wheel construction, similar to that shown in U.S. Pat. No. 5,421,642 to Archibald, the disclosures of the Heck et al., Coleman, and Archibald patents incorporated herein by reference.

As best shown in FIG. 5, the wheel disc 20 is forged, cast, fabricated, or otherwise formed from a suitable material, such as for example, steel, magnesium, titanium, aluminum or other alloys materials. The wheel disc 20 includes a generally centrally located inner wheel mounting portion 22, and an outer annular portion 24 which terminates in a generally axially extending outer annular flange 26. The wheel mounting portion 22 is provided with a centrally located pilot aperture 28, and a plurality of lug bolt receiving holes 30 (only one lug bolt receiving hole 30 is shown), spaced equidistantly from the pilot aperture 28. The lug bolt receiving holes 30 receive lug bolts and nuts (not shown) for securing the vehicle wheel 10 on an axle (not shown) of a vehicle. The wheel mounting portion 22 of the wheel disc 20 further includes an inboard wheel mounting surface 22A which defines an axis Y which is generally perpendicular to the vehicle wheel axis X, and an outboard wheel mounting surface 22B.

The outer annular portion 24 of the wheel disc 20 is provided with a plurality of decorative windows or openings 32 provided therein (only one of such decorative windows 32 illustrated in FIG. 5). The outer annular portion 24 of the wheel disc 20 further includes an inboard surface 24A and an outboard surface 24B. The outer annular flange 26 of the wheel disc 20 includes an inner axially extending cylindrical surface 26A and an outer axially extending cylindrical surface 26B which is substantially parallel to the outer cylindrical surface 26A so as to define a generally constant thickness throughout the entire length of the outer annular flange 26 of the wheel disc 20.

The wheel rim 40 is a fabricated rim constructed of steel, magnesium, titanium, aluminum, or other alloy materials. The wheel rim 40 includes an inboard tire bead seat retaining flange 42, an inboard tire bead seat 44, a generally axially extending well 46, an outboard tire bead seat 48, and an outboard tire bead seat retaining flange 50. The inboard tire bead seat retaining flange 42 includes a generally radially extending inboard surface 42A, and a section of the well 46 includes a generally radially extending inboard surface 46A. The outboard tire bead seat 48 includes a generally axially extending inboard surface 48A, and the outboard tire bead seat retaining flange 50 includes an inboard surface 50A.

To assemble the wheel disc 20 and the wheel rim 40 to produce the vehicle wheel 10 of the present invention, the assembly tooling apparatus 100 of the present invention is used. As will be discussed below, the assembly tooling apparatus 100 of the present invention includes a plurality of tooling members which are moveable between an intermediate working or actuated position, shown in FIG. 1, and a final working or actuated position, shown in FIG. 2, wherein the associated tooling members thereof are operative to support the wheel rim 40 at or near the opposed ends thereof prior to or concurrently with the assembling of the wheel disc 20 and the wheel rim 40.

Figure 2:
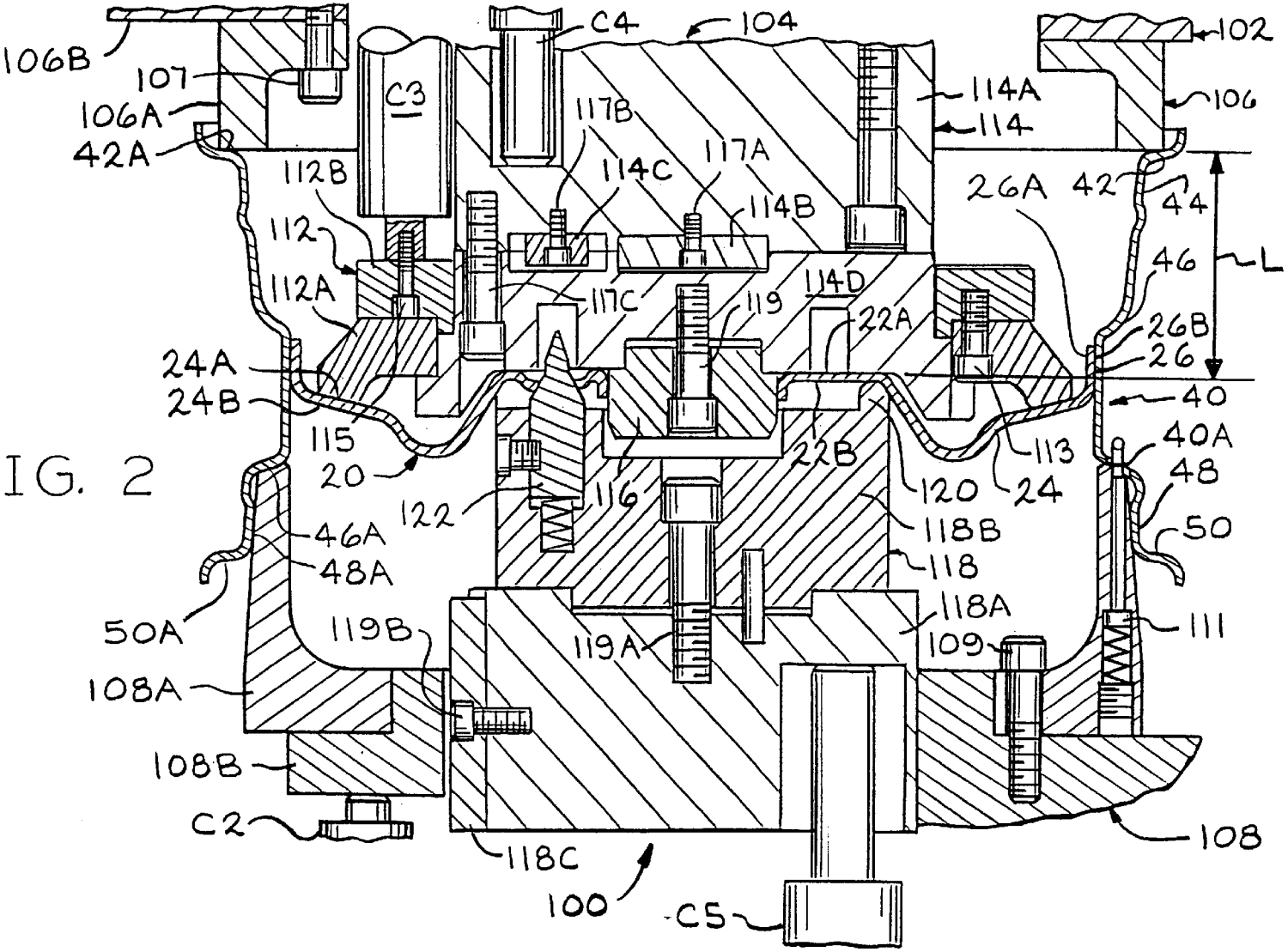
FIG. 2 is a sectional elevational view of the assembly tooling apparatus illustrated in FIG. 1, the assembly tooling apparatus being illustrated in a final working position.

Referring now to FIGS. 1 and 2, the assembly tooling apparatus 100 for producing the vehicle wheel 10 of the present invention includes a wheel rim tooling station, indicated generally at 102, and a wheel disc tooling station, indicated generally at 104. To support the wheel rim 40 in the assembly tooling apparatus 100, the wheel rim 40 is supported by an upper wheel rim detail tooling member 106 and a lower wheel rim detail tooling member 108, both of which are associated with the wheel rim tooling station 104. The upper wheel rim detail tooling member 106 is selectively moveable by a cylinder C1, and the lower wheel rim detail tooling member 108 is selectively moveable by a cylinder C2. The cylinders C1 and C2 are actuated by suitable means, such as by hydraulic, pneumatic, or similar means.

In the illustrated embodiment, the upper wheel rim detail tooling member 106 includes a pair of tooling members 106A and 106B which are connected together by a plurality of bolts 107 (one of such bolts 107 is illustrated in FIGS. 1 and 2). In the illustrated embodiment, the tooling members 106A and 106B are preferably uninterrupted continuous annular tooling members. As a result, the tooling member 106A of the upper wheel rim detail tooling member 106 is effective to engage and support the generally radially extending inboard surface 42A of the inboard tire bead seat retaining flange 42 of the wheel rim 40 around the entire periphery thereof.

The lower wheel rim detail tooling member 108 includes a pair of tooling members 108A and 108B which are connected together by a plurality of bolts 109 (one of such bolts 109 is illustrated in FIGS. 1 and 2). In the illustrated embodiment, the tooling members 108A and 108B are preferably uninterrupted continuous annular tooling members. As a result, the tooling member 108A of the lower wheel rim detail tooling member 108 is effective to engage and support the generally radially outwardly extending inboard surface 46A of a section of the well 46 of the wheel rim 40 around the entire periphery thereof. Also, there may be some contact between the tooling member 108A and a generally axially extending inboard surface 48A of the outboard tire bead seat 48 of the wheel rim 40. In addition, the lower wheel rim detail tooling member 108 is preferably provided with a locating member 111 which is adapted to extend through a valve stem opening 40A provided in the wheel rim 40. Alternatively, the structure of the upper wheel rim detail tooling member 106 and/or the lower wheel rim detail tooling member 108 can be other than illustrated and described if desired. For example, the upper wheel rim detail tooling member 106 and/or the lower wheel rim detail tooling member 108 can include segmented tooling member (s) (i.e., not an uninterrupted continuous tooling member(s)), so as not to provide full (i.e., 360 degree) contact and support at the associated surface(s).

The wheel disc 20 is supported in the assembly tooling apparatus 100 by an outer retainer 112, an inner retainer 114, a center pilot plug 116, and a bottom center detail tooling member 118. The outer retainer 112 is selectively moveable by a cylinder C3, the inner retainer 114 is selectively moveable by a cylinder C4, the center pilot plug 116 is operatively connected to the inner retainer 114 by a bolt 119 and moveable therewith, and the bottom center detail tooling member 118 is selectively moveable by a cylinder C5. The cylinders C3, C4, and C5 are actuated by suitable means, such as by hydraulic, pneumatic, or similar means.

In the illustrated embodiment, the outer retainer 112 includes a pair of tooling members 112A and 112B which are connected together by a plurality of bolts 113 (one of such bolts 113 is illustrated in FIGS. 1 and 2), and the tooling member 112B is operatively connected to the cylinder C4 by a plurality of bolts 115 (one of such bolts 115 is illustrated in FIGS. 1 and 2). In the illustrated embodiment, the tooling members 112A and 112B are preferably uninterrupted continuous annular members which are effective to engage and support an inner surface 24A of the outer annular portion 24 of the wheel disc 20 around the entire periphery thereof. The inner retainer 114 includes a plurality of separate tooling members (four of such tooling members 114A–114D being illustrated in FIGS. 1 and 2), which are operatively connected together by suitable means, such as for example by bolts 117A–117C. In the illustrated embodiment, the tooling member 114D is preferably an uninterrupted continuous annular tooling member which is effective to engage and support the inboard mounting surface 22A of the wheel mounting portion 22 of the wheel disc 20 around the entire periphery thereof. The center pilot plug 116 defines an outer diameter which is slightly greater than an inner diameter defined by the center pilot hole 22A of the wheel disc 20 so as to be received therein in an slight interference fit therewith.

The bottom center detail tooling member 118 includes a plurality of separate tooling members 118A–118C which are connected together by bolt 119A and 119B and which are operatively connected a cylinder C5. The tooling member 118B includes an outer annular extension 120 which is effective to engage the outboard surface 22B of the wheel disc 20 adjacent the bolt hole openings 30 except at the embossed surface areas of the bolt hole openings 30 or any other non-uniform surface area located thereon. The tooling member 118B further includes a locating member 122 which is adapted to extend through a bolt hole opening 30 provided in the wheel disc 20. Alternatively, the structure of one or more of the outer retainer 112, the inner retainer 114, the center pilot plug 116, and the bottom center detail tooling member 118 can be other than illustrated and described if desired. For example, the outer retainer 112, the inner retainer 114, and/or the bottom center detail tooling member 118 can be segmented tooling member(s) (i.e., not uninterrupted continuous tooling member(s)) so as not to provide full (i.e., 360 degree) contact and support at the associated surface(s).

The assembly tooling apparatus 100 of the present invention is operated in the following manner to assemble the wheel disc 20 and the wheel rim 40 in accordance with the present invention. First, the wheel rim 40 and the wheel disc 20 are supported by the assembly tooling apparatus 100 as shown in FIG. 1. In particular, the wheel rim 40 is engaged and supported at the opposed surfaces 42A and 46A by the tooling members 106A and 108A, respectively, and the wheel disc 20 is engaged and supported at the surfaces 24A, 22A, 22B, 28, and 30 by the tooling members 112A, 114D, 118B, 116, and 122, respectively. Next, with the wheel disc 20 held stationary by the tooling members 112, 114, 116, 118, and 122 and the wheel rim 40 "clamped" between tooling members 106 and 108, the wheel rim 40 is preferably moved upwardly relative to the wheel disc 20 in the direction of the arrow M (shown in FIG. 1) a predetermined distance from the position shown in FIG. 1 to the position shown in FIG. 2 so as to "press in" the wheel rim 40 and assemble the wheel rim 40 and the wheel disc 20 together in a press-fit relationship. In particular, the wheel rim 40 and the wheel disc 20 are assembled together so as to precisely locate the inboard mounting surface 22A of the wheel disc 20 a predetermined lateral distance L relative to the inner surface 42A of the inboard tire bead seat retaining flange 42 of the wheel rim 20. Following this, the assembled wheel disc 20 and wheel rim 40 are permanently joined together by a weld 60. Alternatively, the assembly of the wheel rim 40 and the wheel disc 20 can be other than illustrated if desired. For example, the wheel rim 40 can be held stationary and the wheel disc 20 moved relative thereto and pressed therein, or both the wheel rim 40 and the wheel disc 20 can be moved relative to one another.

Figure 3:
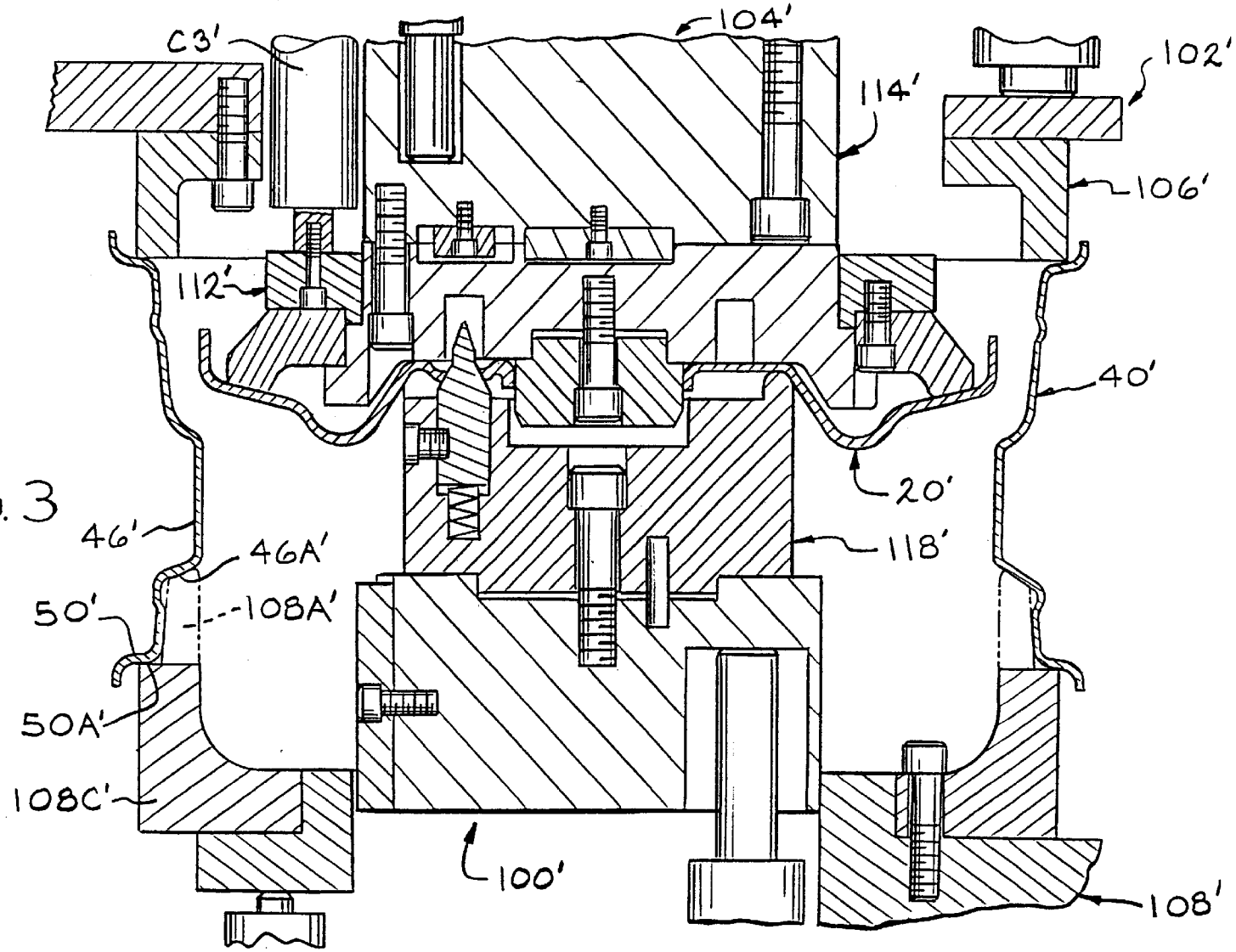
FIG. 3 is a sectional elevational view illustrating a second embodiment of an assembly tooling apparatus for producing a vehicle wheel in accordance with this invention, the tooling assembly apparatus being illustrated in an intermediate working position.

Turning now to FIGS. 3 and 4 and using like reference numbers to indicate corresponding parts, there is illustrated a second embodiment of an assembly tooling apparatus, indicated generally at 100', which can be used to assemble a wheel disc 20' and a wheel rim 40' to produce the vehicle wheel 10 of the present invention. The assembly tooling apparatus 100' shown in this embodiment includes a plurality tooling members which are moveable between an intermediate working position, shown in FIG. 3, and a final working position, shown in FIG. 4, wherein the associated tooling members thereof are operative to support the wheel rim 40' at or near the opposed ends thereof prior to or concurrently with the assembling of the wheel disc 20' and the wheel rim 40'.

As shown therein, the assembly tooling apparatus 100' is similar to the assembly tooling apparatus 100 shown in FIGS. 1 and 2 except for a tooling member 108C' of a lower wheel rim detail tooling member 108'. As shown in this embodiment, the tooling member 108C' is preferably an uninterrupted continuous annular tooling members which is effective to engage and support a generally radially extending outer surface 50A' of an outboard tire bead seat retaining flange 50' of the wheel rim 40' around the entire periphery thereof Alternatively, as shown in phantom in FIGS. 3 and 4, the tooling member 108' can include another tooling member 108A' which can be formed as an extension of the tooling member 108', or which can be formed as a separate tooling member which is operatively connected to the lower detail tooling member 108'. The tooling member 108A' is similar to the tooling member 108A described above in connection with FIGS. 1 and 2 and is operative to engage and support a generally radially extending inner surface 46A' of a section of the well 46 of the wheel rim 40'. The assembly of the wheel rim 40' and the wheel disc 20' using the assembly tooling apparatus 100' is similar to that described above in connection with the assembly tooling apparatus 100 shown in FIGS. 1 and 2.

Figure 6:
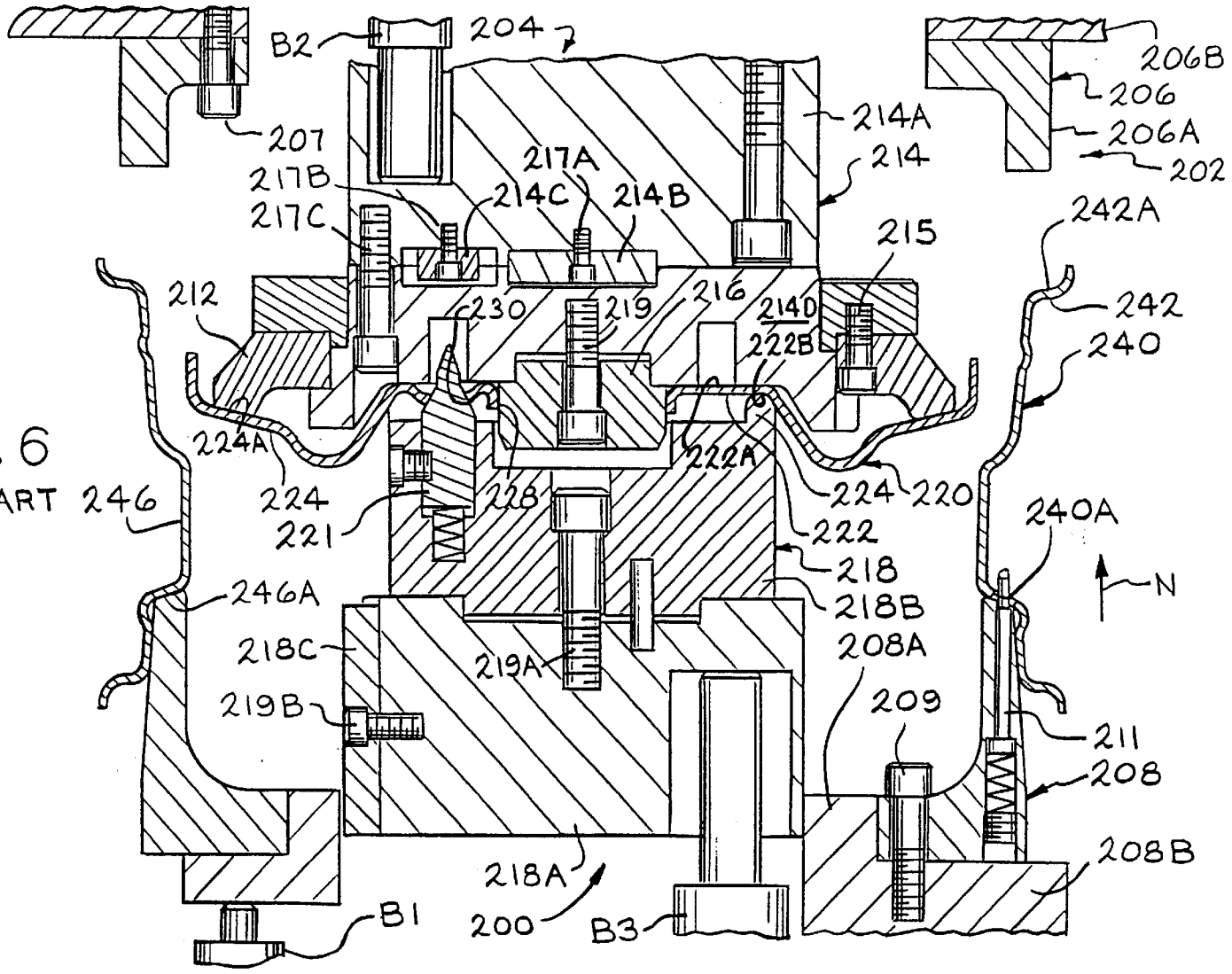
FIG. 6 PRIOR ART
FIG. 6 is a sectional elevational view illustrating a prior art assembly tooling apparatus for producing a prior art vehicle wheel, the prior art assembly tooling apparatus being illustrated in an intermediate working position.
Figure 7:
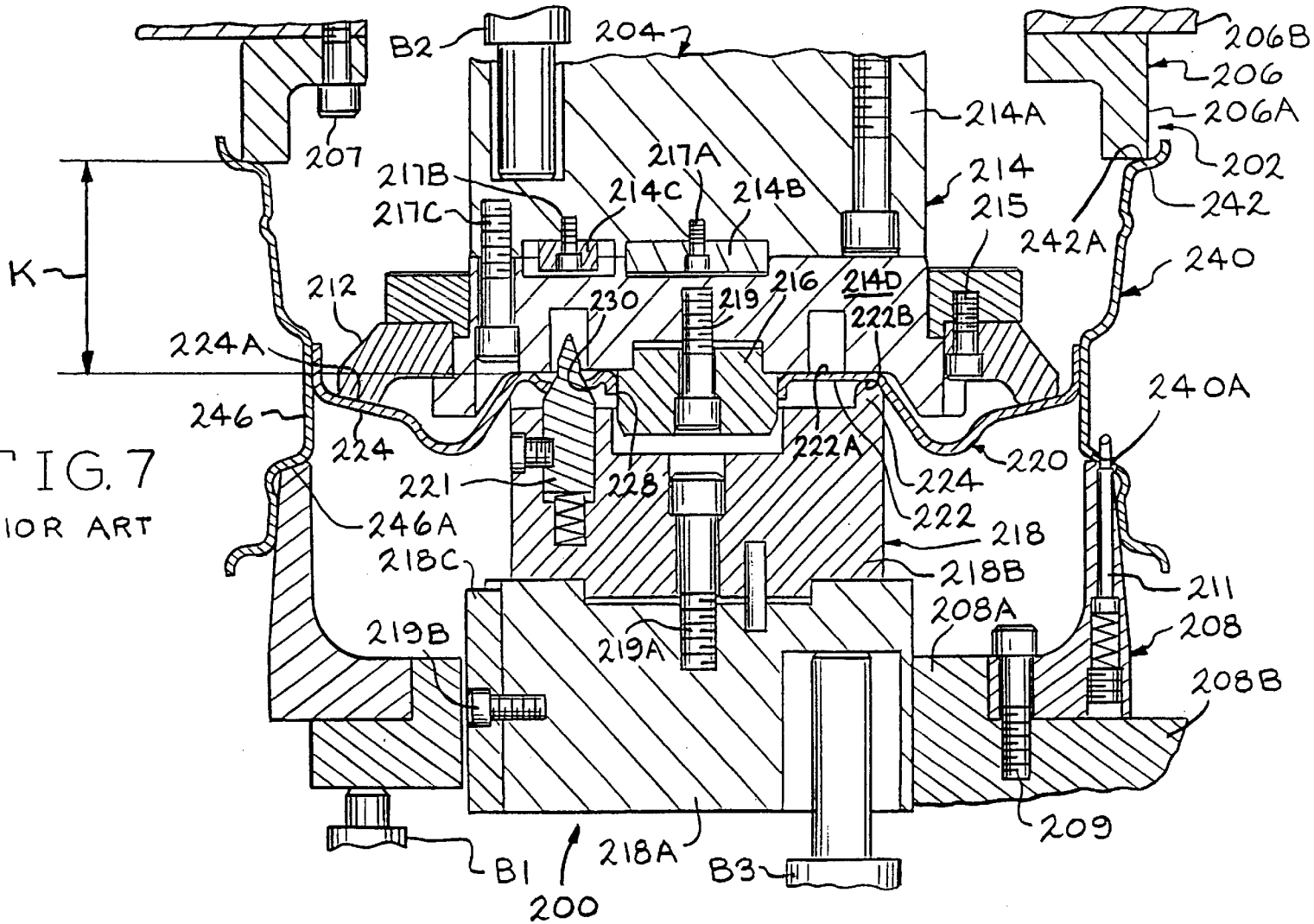
FIG. 7 PRIOR ART
FIG. 7 is a sectional elevational view of the prior art assembly tooling apparatus illustrated in FIG. 6, the prior art assembly tooling apparatus being illustrated in a final working position.

One advantage of the present invention is that the wheel rim 40 and 40' is supported by the respective lower flange detail tooling member 108 and 108' and the respective upper flange detail tooling member 106 and 106' prior to the assembling of the wheel disc 20 and the wheel rim 40. In the prior art tooling assembly 200 shown in FIGS. 6 and 7, the wheel rim 240 is not supported at the inboard end thereof until after the wheel rim 240 is pressed into the wheel disc 220. As a result of this, the present invention provides accurate positioning of the wheel disc 20 relative to the wheel rim 40 during assembly to thereby reduce the lateral runout L in the assembled vehicle wheel 10 and produce a desired lateral runout L defined between the wheel disc inboard mounting surface 22A and 22A' and the respective wheel rim inner surface 42A and 42A'. Also, in the present invention, the outer retainer 112 and 112' is under pressure via the cylinder C3 and C3', respectively. Thus, in the present invention during the assembly of the wheel disc 20 and 20' and the wheel rim 40 and 40', the respective outer retainer 112 and 112' can apply a force against the adjacent surface of the wheel disc 20 and 20'. In the prior art tooling assembly 200 shown in FIGS. 6 and 7, the outer retainer 222 is not operatively connected to a cylinder and therefore, cannot apply a force to the adjacent surface of the wheel disc during the assembly of the wheel rim and the wheel disc. As a result of this, during the pressing in of the wheel rim 40 and 40', the cylinder C3 and C3' is effective to apply a force to the wheel disc counter to the force caused by the wheel rim to thereby reduce the bending or flexing of the wheel disc in the outer region thereof.

In accordance with the provisions of the patent statues, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A method for assembling a wheel rim and a wheel disc together to produce a vehicle wheel comprising the steps of:

(a) providing a wheel rim defining an axis and including an inboard tire bead seat retaining flange, an inboard tire bead seat, a well portion, an outboard tire bead seat, and an outboard tire bead seat retaining flange, the inboard tire bead seat retaining flange including a generally radially extending first inner surface, the well portion including a generally radially extending second inner surface, the outboard tire bead seat retaining flange including a generally radially extending third inner surface;

(b) providing a wheel disc having a generally centrally located inner wheel mounting portion and an outer annular portion which terminates in a generally axially extending outer annular flange, the inner wheel mounting portion including an inboard mounting surface and an outboard mounting surface, the outer annular portion including an inner surface;

(c) providing a wheel rim tooling station to support the wheel rim, the wheel rim tooling station including an upper wheel rim detail tooling member and a lower wheel rim detail tooling member, the upper wheel rim detail tooling member including an uninterrupted continuous annular tooling member, the lower wheel rim detail tooling member including an uninterrupted continuous annular tooling member;

(d) providing a wheel disc tooling station to support the wheel disc, the wheel disc tooling station including an outer retainer, an inner retainer, a center pilot plug, and a bottom center detail tooling member, the outer retainer being operatively connected to and selectively moveable by a cylinder and including an uninterrupted continuous annular tooling member;

(e) operating the wheel rim tooling station whereby the uninterrupted continuous annular tooling member of the upper wheel rim detail tooling member is operative to engage and support the first inner surface of the wheel rim around the entire periphery thereof, and the uninterrupted continuous annular tooling member of the lower wheel rim detail tooling member is operative to engage and support at least one of the second inner surface and the third inner surface of the wheel rim around the entire periphery thereof;

(f) operating the wheel disc tooling station whereby the inner retainer and the bottom center detail tooling member are operative to engage and support the wheel disc at the inboard mounting surface and the outboard mounting surface, respectively, of the inner wheel mounting portion, and the uninterrupted continuous annular tooling member of the outer retainer is operative to engage and support the inner surface of the outer annular portion of the wheel disc around the entire periphery thereof;

(g) selectively moving at least one of the wheel rim and the wheel disc toward one another to cause the outer annular flange of the wheel disc to engage an inner surface of the wheel rim in a press fit engagement therewith while supporting the wheel rim and the wheel disc as recited in steps (e) and (f), the wheel rim and the wheel disc being selectively moved to produce a desired lateral runout dimension defined between the inboard mounting surface of the wheel disc and the first inner surface of the inboard tire bead seat retaining flange of the wheel rim;

(h) simultaneously with step (g), operating the cylinder of the wheel disc tooling station so as to apply a force against the inner surface of the outer annular portion of the wheel disc which is operative to counter an opposing force caused by the wheel rim during the press fit engagement of step (g) to thereby reduce the bending or flexing of the wheel disc in the region of the outer annular portion; and (i) subsequent to step (h), welding the wheel disc to the wheel rim to thereby permanently join the wheel rim and the wheel disc together and produce the vehicle wheel.

2. The method according to claim 1 wherein the upper wheel rim detail tooling member is selectively moveable and the lower wheel rim detail tooling member is selectively moveable.

3. The method according to claim 1 wherein the upper wheel rim detail tooling member includes a locating member adapted to extend through a valve stem opening provided in the wheel rim.

4. The method according to claim 1 wherein the center pilot plug is operatively connected to the inner retainer and moveable therewith.

5. The method according to claim 1 the outer retainer is selectively moveable, the inner retainer is selectively moveable, the center pilot plug is selectively moveable, and the bottom center detail tooling member is selectively moveable.

6. The method according to claim 1 wherein the center pilot plug defines an outer diameter which is slightly greater than an inner diameter defined by a center pilot hole of the wheel disc so as to be received therein in a slight interference fit therewith.

7. The method according to claim 1 wherein bottom center detail tooling member includes a locating member which is adapted to extend through a bolt hole opening provided in the wheel disc.

8. The method according to claim 1 wherein during step (g) the wheel rim is moved relative to the wheel disc.

9. A method for assembling a wheel rim and a wheel disc together to produce a vehicle wheel comprising the steps of:

(a) providing a wheel rim defining an axis and including an inboard tire bead seat retaining flange, an inboard tire bead seat, a well portion, an outboard tire bead seat, and an outboard tire bead seat retaining flange, the inboard tire bead seat retaining flange including a generally radially extending first inner surface, the well portion including a generally radially extending second inner surface, the outboard tire bead seat retaining flange including a generally radially extending third inner surface;

(b) providing a wheel disc having a generally centrally located inner wheel mounting portion and an outer annular portion which terminates in a generally axially extending outer annular flange, the inner wheel mounting portion including an inboard mounting surface and an outboard mounting surface, the outer annular portion including an inner surface;

(c) providing a wheel rim tooling station to support the wheel rim, the wheel rim tooling station including an upper wheel rim detail tooling member and a lower wheel rim detail tooling member;

(d) providing a wheel disc tooling station to support the wheel disc, the wheel disc tooling station including an outer retainer, an inner retainer, a center pilot plug, and a bottom center detail tooling member, the outer retainer being operatively connected to and selectively moveable by a cylinder and including an uninterrupted continuous annular tooling member;

(e) operating the wheel rim tooling station whereby the upper wheel rim detail tooling member is operative to engage and support the first inner surface of the wheel rim, and the lower wheel rim detail tooling member is operative to engage and support at least one of the second inner surface and the third inner surface thereof;

(f) operating the wheel disc tooling station whereby the inner retainer and the bottom center detail tooling member are operative to engage and support the wheel disc at the inboard mounting surface and the outboard mounting surface, respectively, of the inner wheel mounting portion, and the uninterrupted continuous annular tooling member of the outer retainer is operative to engage and support the inner surface of the outer annular portion of the wheel disc around the entire periphery thereof;

(g) selectively moving at least one of the wheel rim and the wheel disc toward one another to cause the outer annular flange of the wheel disc to engage an inner surface of the wheel rim in a press fit engagement therewith while supporting the wheel rim and the wheel disc as recited in steps (e) and (f), the wheel rim and the wheel disc being selectively moved to produce a desired lateral runout dimension defined between the inboard mounting surface of the wheel disc and the first inner surface of the inboard tire bead seat retaining flange of the wheel rim;

(h) simultaneously with step (g), operating the cylinder of the wheel disc tooling station so as to apply a force against the inner surface of the outer annular portion of the wheel disc which is operative to counter an opposing force caused by the wheel rim during the press fit engagement of step (g) to thereby reduce the bending or flexing of the wheel disc in the region of the outer annular portion; and (i) subsequent to step (h), welding the wheel disc to the wheel rim to thereby permanently join the wheel rim and the wheel disc together and produce the vehicle wheel.

10. The method according to claim 9 wherein the upper wheel rim detail tooling member is selectively moveable and the lower wheel rim detail tooling member is selectively moveable.

11. The method according to claim 9 wherein the upper wheel rim detail tooling member includes a locating member adapted to extend through a valve stem opening provided in the wheel rim.

12. The method according to claim 9 wherein the center pilot plug is operatively connected to the inner retainer and moveable therewith.

13. The method according to claim 9 the outer retainer is selectively moveable, the inner retainer is selectively moveable, the center pilot plug is selectively moveable, and the bottom center detail tooling member is selectively moveable.

14. The method according to claim 9 wherein the center pilot plug defines an outer diameter which is slightly greater than an inner diameter defined by a center pilot hole of the wheel disc so as to be received therein in a slight interference fit therewith.

15. The method according to claim 9 wherein bottom center detail tooling member includes a locating member which is adapted to extend through a bolt hole opening provided in the wheel disc.

16. The method according to claim 9 wherein during step (g) the wheel rim is moved relative to the wheel disc.

17. An apparatus for assembling a wheel rim and a wheel disc together to produce a vehicle wheel, the wheel rim defining an axis and including an inboard tire bead seat retaining flange, an inboard tire bead seat, a well portion, an outboard tire bead seat, and an outboard tire bead seat retaining flange, the inboard tire bead seat retaining flange including a generally radially extending first inner surface, the well portion including a generally radially extending second inner surface, the outboard tire bead seat retaining flange including a generally radially extending third inner surface, the wheel disc having a generally centrally located inner wheel mounting portion and an outer annular portion which terminates in a generally axially extending outer annular flange, the inner wheel mounting portion including an inboard mounting surface and an outboard mounting surface, the outer annular portion including an inner surface, the apparatus comprising:

a wheel rim tooling station having an upper wheel rim detail tooling member and a lower wheel rim detail tooling member, said upper wheel rim detail tooling member including an uninterrupted continuous annular tooling member, said upper wheel rim detail tooling member and said lower wheel rim detail tooling member being selectively moveable toward and away from one another whereby said upper wheel rim detail tooling member is operative to engage and support the first inner surface of the wheel rim and said lower wheel rim detail tooling member is operative to engage and support at least one of the second inner surface and the third inner surface of the wheel rim prior to the assembling of the wheel rim and the wheel disc; and a wheel disc tooling station having an outer retainer, an inner retainer, a center pilot plug, and a bottom center detail tooling member, said outer retainer including an uninterrupted continuous annular tooling member, said outer retainer, said inner retainer, said center pilot plug, and said bottom center detail tooling member being selectively moveable so as to engage and support the wheel disc at least at the inboard mounting surface and the outboard mounting surface thereof prior to the assembling of the wheel rim and the wheel disc;

wherein said outer retainer is operatively connected to a cylinder so as to apply a force against the inner surface of the outer annular portion of the wheel disc during the assembling of the wheel rim and the wheel disc which is operative to counter an opposing force caused by the wheel rim during the assembling of the wheel disc and the wheel rim to thereby reduce the bending or flexing of the wheel disc in the region of the outer annular portion.

* * * * *